United States Patent [19]

Mueller

[11] Patent Number: 4,950,869

[45] Date of Patent: Aug. 21, 1990

[54] FROST CONTROL SYSTEM FOR HIGH-SPEED MECHANIZED DOORS

[75] Inventor: Louis B. Mueller, Richfield, Wis.

[73] Assignee: Rytec Corporation, Jackson, Wis.

[21] Appl. No.: 259,689

[22] Filed: Oct. 19, 1988

Related U.S. Application Data

[63] Continuation-in-part of Ser. No. 144,572, Jan. 15, 1988, Pat. No. 4,855,567.

[51] Int. Cl.[5] ..... H05B 3/84; F25D 21/08

[52] U.S. Cl. ..... 219/218; 219/213; 62/248

[58] Field of Search ..... 219/213, 218, 528, 529, 219/548, 549, 522, 543; 62/255, 256, 248, 275

[56] References Cited

U.S. PATENT DOCUMENTS

| | | | |
|---|---|---|---|
| 2,731,804 | 1/1956 | Grubbs | 219/218 |
| 2,858,408 | 10/1958 | Barroero | 219/218 |
| 3,141,954 | 7/1964 | Simon | 219/549 |
| 3,186,185 | 6/1965 | Bently | 62/256 |
| 3,612,821 | 10/1971 | Stromquist | 62/248 |
| 3,697,723 | 10/1972 | Winsler | 219/218 |
| 4,109,484 | 8/1978 | Cunningham | 62/256 |
| 4,516,482 | 5/1985 | Smith | 62/248 |

FOREIGN PATENT DOCUMENTS 2170893A 2/1986 United Kingdom .

OTHER PUBLICATIONS

Electrical Construction and Maintenance, vol. 67, No. 7, Jul. 1968, p. 134.

*Primary Examiner*—Teresa J. Walberg
*Attorney, Agent, or Firm*—Foley & Lardner

[57] ABSTRACT

A frost control system for a freezer door which has a header disposed along the top of a doorway for supporting a downwardly depending curtain configured for movement between a closed, extended position and an open, retracted position. Heating elements are secured to the header to inhibit frost formation on the header. In an alternate embodiment, a heat lamp is disposed on the "warm" side of the curtain proximate the doorway for directing radiant heat at the curtain to thereby inhibit the formation of frost thereon.

18 Claims, 8 Drawing Sheets

FROST CONTROL SYSTEM FOR HIGH-SPEED MECHANIZED DOORS

This is a Continuation-in-Part of U.S. patent application Ser. No. 144,572, filed Jan. 15, 1988 now U.S. Pat. No. 4,855,567.

TECHNICAL FIELD

This invention relates to a system for controlling the buildup of frost or ice on the operating mechanism or on the curtain material or in the door opening of high-speed, mechanized doors used in low temperature environments such as a freezer case in a cold storage warehouse, meat packing facility, frozen food plant or the like.

BACKGROUND OF THE INVENTION

In recent years the industrial door industry has been revolutionized by the introduction of two new types of industrial doors—high-speed horizontal folding doors and high-speed sliding doors.

In the early 1980's high-speed horizontal folding doors were introduced successfully into industrial and commercial use in Europe. The first such doors were installed in the United States in about 1985. These doors are typified by a horizontally folding door curtain, a header at the top of the door which supports the door suspension and contains an electrical, pneumatic or hydraulic actuating mechanism which causes the door curtain to rapidly fold to one or both of the outer edges or jambs of the door frame into a fan-fold position. The door curtain is attached to folding arms at the top of the door opening which are in turn suspended from a guide track attached to the header and connected to the actuating mechanism within the header. The door curtain itself may be in the form of panels of fabric or other sturdy, flexible material descending from the folding arms. Optimally, this descending curtain is made of a strong, clear, flexible plastic material which permits it to serve its function as a closure for the door opening while permitting the operators of vehicles and the like to see through the door for safety and traffic control purposes. Vertical hinge means at one or both sides or jambs of the door opening cooperate with the folding mechanism within the header of the door and retain the outermost edge of the door curtain within close proximity to the door jamb.

A pioneering example of such a door is found in German Patent No. 3,048,763 to Klein.

More recently the inventor's assignee has developed a new high-speed sliding door which is readily adaptable to use a transparent curtain similar to the transparent curtain of the high-speed horizontal folding door described above. This new door utilizes some mechanical features similar to those in the high-speed folding door described above, including carrying the door weight by a roller carriage in a track.

These high-speed see-through doors have revolutionized the industrial door business. Because the doors are transparent, operators can see through them readily, insuring that safety is maintained. Such doors can be fast operating—a typical 35' door folding cycling opened and closed in 5 seconds or less. A typical 10' folding door of this type can cycle in 3 seconds or less. A typical sliding door of the type described above can cycle in 10 seconds or less.

Because the doors are able to operate so rapidly, as compared to previously available industrial sliding, rollup or swinging doors, they are particularly useful in situations where there is a sizable difference between the temperatures on either side of the door. A typical example would be a warehouse where such a high-speed door may be utilized between an air-conditioned working structure and an outside loading dock. The door, in such a case, would be fitted with an automatic control in the form of an electric eye beam, pressure treadle or the like which would actuate the door when triggered by a forklift or other vehicle. The door would open rapidly, the forklift would go through actuating a closing control circuit, and the door would swiftly close behind, thereby minimizing the amount of time the door was open and helping to preserve the air-conditioned environment on the inside of the building. No other type of previously known industrial or commercial door is as effective as the high-speed door for such installations.

Another advantage of high-speed doors is that they may be manufactured easily in a variety of large sizes up to about 50' wide and 28' high and are thus suitable for a wide variety of industrial and commercial applications.

Industrial doors comprising a series of adjacent flexible plastic strips suspended from a doorway are generally known in the prior art. See, for example, Catan U.S. Pat. No. 4,289,190 issued Sept. 15, 1981, Barbant U.S. Pat. No. 4,449,270 issued May 22, 1984, Schaefer U.S. Pat. No. 4,388,961 issued June 21, 1983, Romano U.S. Pat. No. 4,355,678 issued Oct. 26, 1982, Simon U.S. Pat. No. 4,335,777 issued June 22, 1982, and Sills U.K. Patent Application No. 2,080,379 published Feb. 3, 1982.

High-speed industrial folding doors of the type previously discussed include a door curtain in the form of a series of overlapping panels, strips or hinged sections which draw to one side in a fan-folded position. Typical suspension systems for such folding door curtains include a series of rack sections connected to each corresponding section of the curtain secured to suitable means for effecting a fan-fold opening and closing movement. Each rack section typically can be connected to an overhead guide track by a series of pins pivotally connected to rollers, as illustrated by Romano U.S. Pat. No. 4,083,395 issued Apr. 11, 1978. In lieu of rollers, simple sliding support devices can be employed, such as described in Sandall U.K. Patent Specification No. 1,554,159 published Oct. 17, 1979. The wheels or support devices are typically interlocked with the guide track. Comeau U.S. Pat. No. 4,274,467 issued June 23, 1981, illustrates such a fan-fold type drapery suspension system.

As described previously, high-speed doors have proved highly useful, particularly in industrial situations where the environment on one side of the door is markedly different from the environment on the other side of the door. A further example of a situation of this sort which can provide very difficult operating conditions for such a door is a meat packing plant in which the plant building contains a freezer room in which meat is kept in a frozen condition. In such a situation the main part of the building might be at normal room temperature, say 60° to 70° F., while the freezer compartment would be at 30° F. or less. Because of the large amount of money invested in energy for keeping such freezer rooms cold, in the past such rooms have been typically fitted with doors of one kind or another. The high-speed doors of the sort previously described are particularly suited to such an application and enable vehicles and workmen to pass in and out of the freezer compartment with a minimum door opening time and with good visibility.

In practice, in such an environment, a number of problems arise. For example, contact of warm, moisture laden air from the warm side of the door opening with the chilled components of the door causes frost and ice to form on the door components and the floor of the door opening.

In particular, frost or ice formation at four separate locations in horizontal folding door installations causes interference with the proper function of the door. These are:

(1) at the header and guide track where the door-actuating mechanism is located. If frost or ice forms sufficiently thickly on the header or guide track, it interferes with the movement of the folding arms, the seal members or the carriage of the door, thereby negatively affecting the operation of the door;

(2) at the side hinge pipe or pipes of the door where ice formation on the side jambs of the door causes interference with the hinge pipe on which the outermost panel of the door pivots, thereby affecting the overall operation of the door;

(3) on the material of the door itself. Since these doors are particularly effective when made out of a transparent material so that vehicle operators and others may see through door in advance of door opening, any formation of frost or ice obscuring vision through the door would defeat one of the principle purposes of such a door; and (4) on the floor of the door opening. Frost and ice accumulation at this point is plainly a safety risk and must be controlled. Frost and ice accumulation on the floor of the door opening can also present operational difficulties. If frost and ice build up sufficiently, it can reach the lower edges of the transparent, flexible strips of the door curtain, abrading and damaging the edges. In some cases, frost on the floor is brushed toward the jambs of the door by the movement of the door curtain and eventually accumulates in the area of the jambs. Such accumulation interferes with the proper folding of the individual panels of the door curtain.

High-speed sliding doors are also susceptible to frost or ice formation causing interference with the proper function of the door. These can include:

(1) At the header and guide track where the door slides from one side to the other. If frost or ice forms sufficiently thickly on the header or guide track, it interferes with the sliding carriages for the door, thereby negatively affecting the operation of the door;

(2) At the side jambs of the door where the ice or frost accumulation interfere with the door and its sealing with the door opening;

(3) On the material of the door itself. Just like the folding door described above, transparent material is an important adjunct to high-speed sliding doors. The usefulness is such transparent material for the door is obviated if the door is obscured by frost or ice; and (4) On the floor of the door opening. As with the high-speed folding door described above,.frost and ice accumulation on the floor of the door opening is a safety risk and must be controlled.

In the past, the art has made numerous attempts to deal with frost and ice formation in doors for various refrigerated structures. Numerous workers in the prior art have endeavored to use various heating devices to prevent frost formation around the sealing edges of conventional swinging doors as found on household refrigerators and freezers. See, for example, Knight U.S. Pat. No. 1,992,011 issued Feb. 19, 1935; Haggerty U.S. Pat. No. 2,420,240 issued May 6, 1947; Foster U.S. Pat. No. 2,493,125 issued Jan. 3, 1950; Southworth U.S. Pat. No. 2,809,402 issued Oct. 15, 1957; Taylor U.S. Pat. No. 3,135,100 issued June 2, 1964; Grubbs U.S. Pat. No. 2,731,804 issued Jan. 24, 1956; Rundell U.S. Pat. No. 3,254,503 issued June 7, 1966; Thomas U.S. Pat. No. 3,869,873 issued Mar. 11, 1975; Stowik U.S. Pat. No. 4,080,764 issued Mar. 28, 1978; Thaxter U.S. Pat. No. 2,238,511 issued Apr. 15, 1941; Barroero U.S. Pat. No. 2,858,408 issued Oct. 28, 1958; Barroero U.S. Pat. No. 3,449,925 issued June 17, 1969; Rifkin U.S. Pat. No. 2,460,469 issued Feb. 1, 1949; Miller U.S. Pat. No. 3,462,885 issued Aug. 26, 1969; McQueen U.S. Pat. No. 4,448,232 issued May 15, 1984; Gidge U.S. Pat. No. 4,313,485 issued Feb. 2, 1982 and Gidge U.S. Pat. No. 4,420,027 issued Dec. 13, 1983.

Workers in the prior art have also endeavored to devise various systems to prevent frost and ice interference with horizontal and vertical sliding doors, for example, in Thaxter U.S. Pat. No. 2,238,511 issued Apr. 15, 1941; Barroero U.S. Pat. No. 2,858,408 issued Oct. 28, 1958; Barroero U.S. Pat. No. 3,449,925 issued June 17, 1969.

The prior art has also endeavored to prevent frost formation at the sealing joints of refrigerated cases utilizing pull-out drawers, e.g., Rifkin U.S. Pat. No. 2,460,469 issued Feb. 1, 1949.

Rytec Corporation of Jackson, Wis. has marketed high-speed folding doors including flaccid heat wires in the header and jambs of the door for frost prevention. In these prior art doors the flaccid heat wires were retained in place by heat resistant tape. In practice it was found that such a structure was slow and expensive to manufacture and that the taped-in-place heat wires did not always stay in place in service resulting in non-uniform heating of the header or jamb and attendant service problems.

As is evident, the art has not successfully directed itself to the prevention of frost and ice formation in high-speed doors or in the prevention of frost and ice formation which interferes with the actuating mechanism of a power operated door at low manufacturing cost and good in-service reliability.

Nor has the prior art directed its attention to the prevention of frost and ice formation on the clear curtain panels of a high-speed door, although transparent curtain doors have been used in environments where frost formation is likely to be a problem; e.g. Gidge U.S. Pat. No. 4,313,485 issued Feb. 2, 1982 and Gidge U.S. Pat. No. 4,420,027 issued Dec. 13, 1983.

The present invention substantially prevents frost and ice formation interfering with the action of a high-speed, power operated horizontal folding door or a high-speed, horizontal sliding door and substantially prevents ice and frost formation on the transparent descending curtain of the door and on the floor of the door opening. The present invention does so with low utilization of energy; at relatively low manufacturing cost; with manufacturing ease and with in-service reliability.

SUMMARY OF THE INVENTION

A high-speed, horizontal folding door for use in refrigerated cases according to the present invention includes an elongated guide track and actuating mechanism in association with a header including a suitable door actuating mechanism. In close proximity with the header is a folding arm mechanism which permits the door to fold while opening and closing and provides the means whereby the curtain of the door is suspended. At one or both of the opposing jambs of the door vertical hinge pipes are provided on which the outermost panel and suspending arms of the door pivots during the operation of the door.

A high-speed sliding door for use in refrigerated cases, according to the present invention, includes an elongated guidetrack and actuating mechanism in association with a header, including a suitable door actuating mechanism. In close proximity the the header is a roller carriage which permits the door to slide while opening and closing and provides the means whereby the curtain of the door is suspended.

The frost control system for a folding door in accordance with the present invention includes heating elements at the header and jambs of the door at those locations where frost or ice formation interfere with the operation of the door, obscure vision through a transparent door curtain or create a safety hazard. In practice, four such locations are the exterior of the header of the door in close proximity to the guide track, moving arms and seal members of the door, the door jamb or jambs, the door curtain and the floor of the door opening.

The frost control system for a sliding door in accordance with the present invention includes heating elements at the header and track of the door at those locations where frost or ice formation interfere with the operation of the door, obscure vision through a transparent door curtain or create a safety hazard. In practice, three such locations are the exterior of the header of the door in close proximity to the guide track, the door curtain and the floor of the door opening.

DESCRIPTION OF THE DRAWINGS

The invention will be further described with reference to the appended drawings, and.

DETAILED DESCRIPTION OF THE PREFERRED EXEMPLARY EMBODIMENTS

Figure 2:
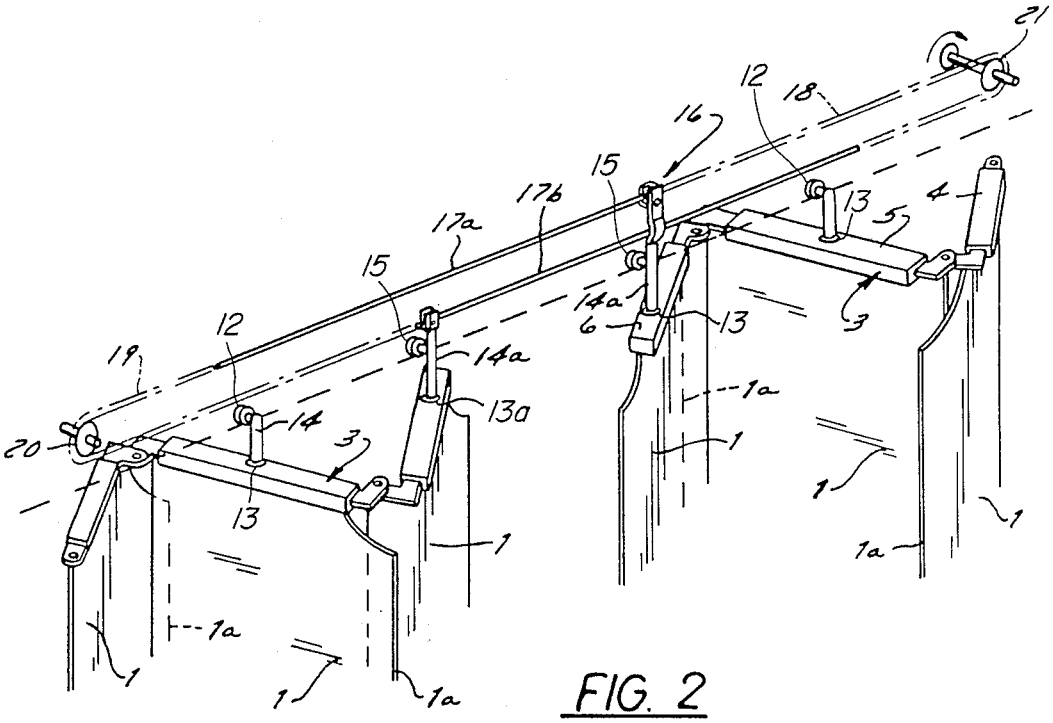
FIG. 2 PRIOR ART
FIG. 2 is a partial, perspective view of suspension system of the prior art for a high-speed, horizontal folding door.
Figure 3:
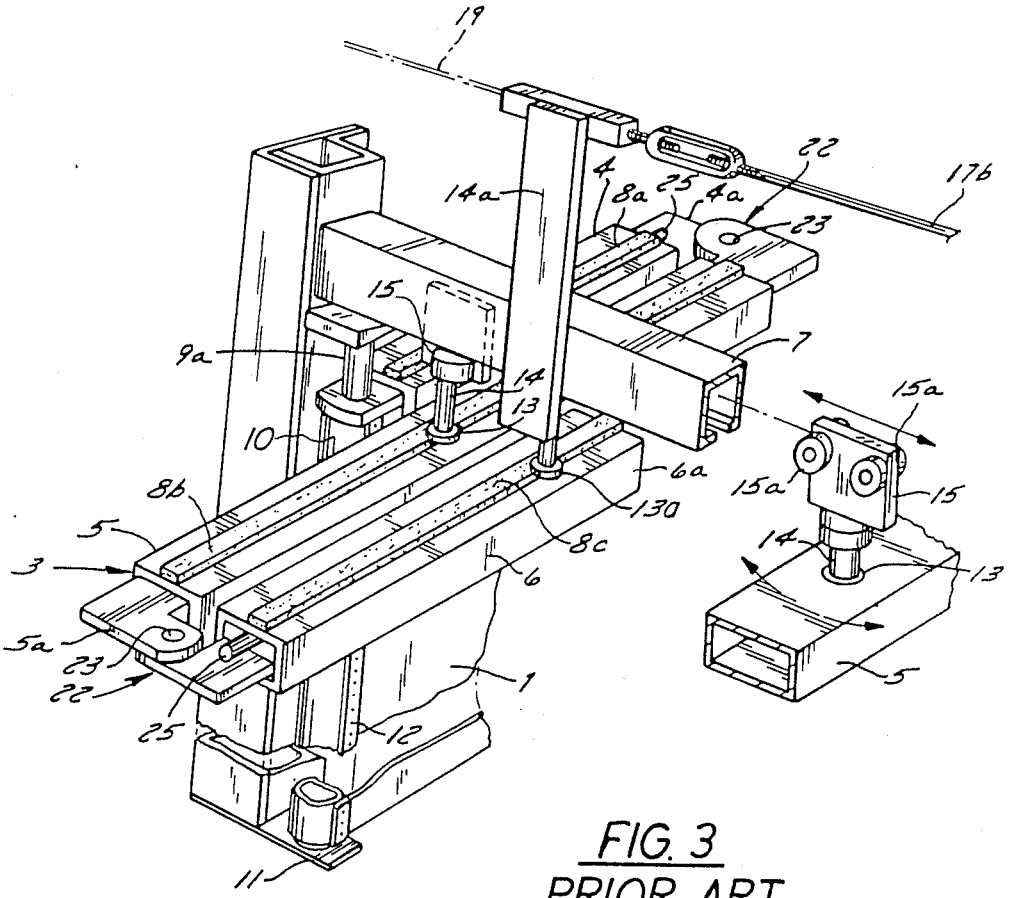
FIG. 3 PRIOR ART
FIG. 3 is an enlarged partial perspective view of the suspension system shown in FIG. 2.

As previously described, FIGS. 2–3 generally illustrate a high-speed, horizontal folding door of the type generally contemplated for use in conjunction with the frost control system of the invention. Such a known design for a horizontal folding door combines the advantages of an overhead suspension system including a series of hinged, fan-foldable rack sections with a means for automatically opening and closing the door. Klein proposed such a system in German Patent No. 3,048,763 published Sept. 6, 1983. The entire contents of the German Patent No. 3,048,763 are hereby expressly incorporated herein by reference. Doors of the Klein type have been manufactured and sold by Rytec Corporation, Jackson, Wis. since about 1985.

As shown in FIGS. 2 and 3, a known folding door for use with the present invention includes a series of flexible transparent strips 1 having overlapping edge portions la each attached to a rack 3 consisting of jointed folding arms or sections 4, 5 and 6 which can be folded along a guide track 7. In installations, such as freezer cases, where limiting air infiltration past the door is important, seal members 8*a*, 8*b* and 8*c* are fitted to the top surface of each of folding arms 4, 5 and 6 to close the gap between folding arms 4, 5 and 6 and guide track 7 when the door is closed. Seal members 8*a'* 8*b* and 8*c* may be either flexible elastomeric blades of appropriate length suitably secured to the upper surface of arms 4, 5 and 6 or flexible polymeric bristles of appropriate length suitably secured to the upper surface of arms 4, 5 and 6. Such blades or bristles are readily available from a number of sources known to workers in the art.

Section 4 located nearest the doorway edge is linked to a bearing bolt 9*a* attached to a side jamb 9 below guide track 7. A hinge pipe 10 is pivotally connected to bearing bolt 9*a* and descends downwardly from bearing bolt 9*a* to pivotal attachment with a bearing plate 11. Hinge pipe 10 is fitted with a flange 12 to which the outer edge of outer flexible transparent strip 1 is attached.

A free end 4*a* of rack section 4 is joined to second rack section 5 of double length which is attached at its center by a swivel joint 13 and a support rod 14 to a carriage 15 which comprises a vertically oriented plate having a series of rollers 15*a* mounted thereon. Rollers 15*a* engage the inner periphery of guide track 7, as illustrated in FIG. 3.

Second rack section 5 has an end 5a connected to third rack section 6 which moves in parallel with first rack section 4. An end portion 6a of rack section 6 is attached by a swiveling joint 13a and an extended support rod 14a.

A draw cable assembly 16 and a pair of draw rods 17a, 17b are disposed above guide track 7 and are connected to extended support rods 14a of rack section 6. Sprocket chains 18, 19 connected to draw rods 17a, 17b are guided by sprocket wheels 20, 21, at least one of which is powered by a suitable motor (not shown) to turn in either direction to open and close the door, respectively.

Hinge pins 23 of hinges 22 connecting respective rack sections 4, 5 and 6 are offset relative to an imaginary vertical longitudinal plane bisecting rack sections 5, 6. This allows sections 4, 5, 6 to fold parallel to each other in the manner shown in FIG. 3. Hinge connections 22 may further have spring biased studs 25 which protrude from the end of at least one of each two adjoining sections 4, 5 and 5, 6 which assist hinging by exerting pressure on abutment end surface 26 of rack section end 5a, as illustrated in FIG. 3.

The foregoing detailed description of the folding door is recited here as the present invention has features in common with this type of known folding door and tracking system. However, the invention is readily applicable to folding doors having other types of specific mechanisms.

Figure 4:
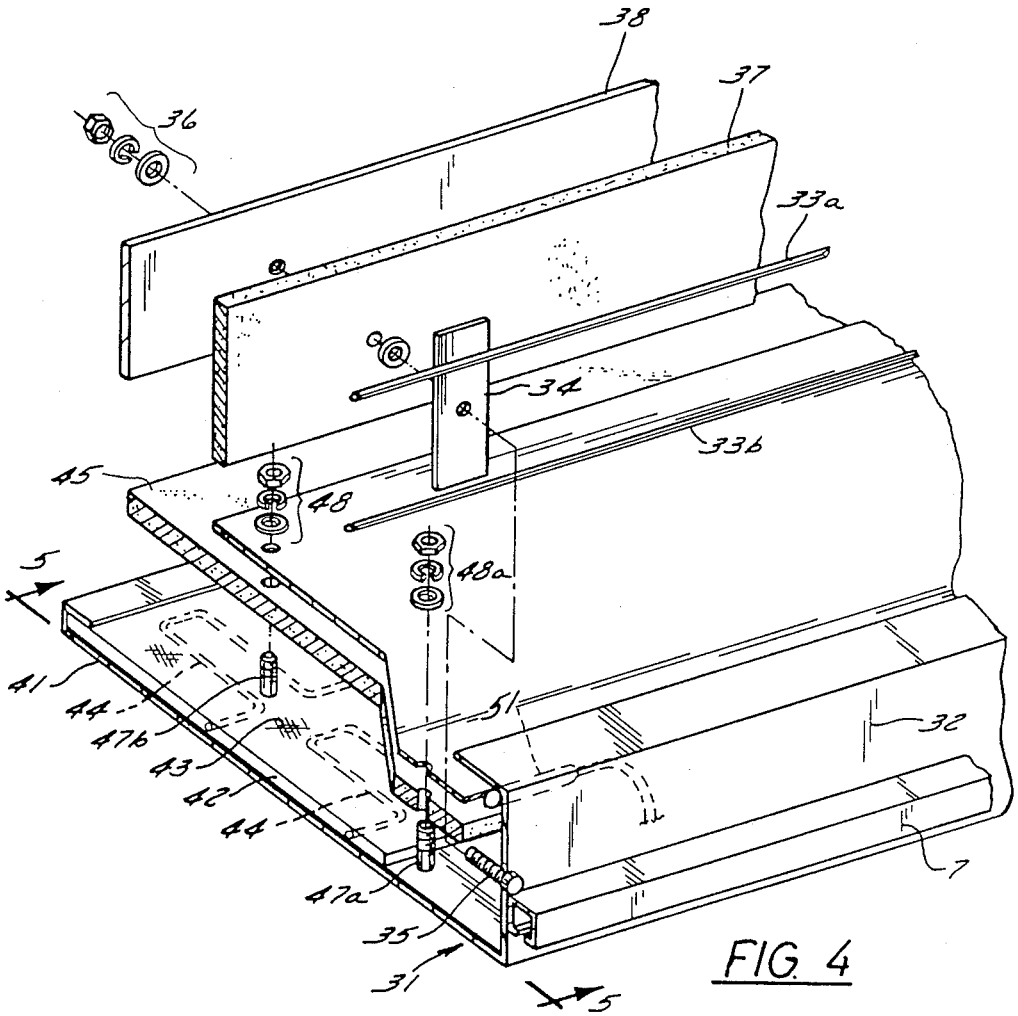
FIG. 4 is an exploded, sectional perspective view taken along line 4—4 in FIG. 1 of the header portion of the invention.
Figure 5:
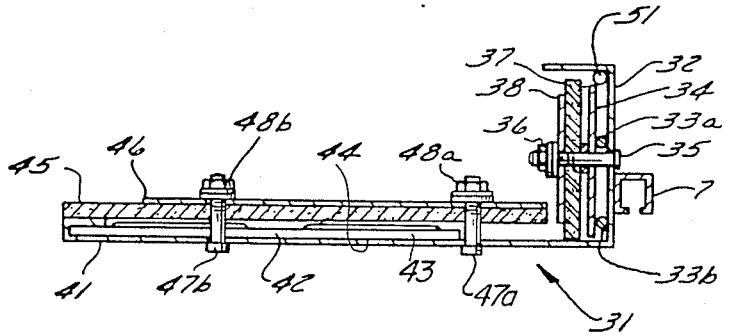
FIG. 5 is a sectional view taken along line 5—5 in FIG. 4 of the structure of FIG. 4 in assembled condition.

FIGS. 4–5 illustrate a preferred embodiment of the frost control system according to the present invention in which guide track 7 is attached to a front vertical support panel 32 which is integrally a part of the header 31. A header is generally constructed of a heavy gauge sheet steel.

On the inside of front vertical support panel 32 of header 31, one or more heating elements 33a and 33b are placed in intimate contact with the interior surface of vertical support panel 32. Preferably, the heating elements should be in the form of electrical copper tube heaters capable of heat output on the order of 10 watts per linear foot of heater. Such copper tube heaters are available from Easy Heat, Inc., New Carlisle, Ind.

Intimate contact between heat tubes 33a and 33b with the inside surface of vertical support panel 32 is maintained by a retention plate 34 which slips over a stud 35 and is clamped in place against the inside surface of vertical face 32 by the action of a clamping means 36 comprising a washer, lockwasher and nut as will be more fully described. Stud 35 and clamping means 36 should be repeated at sufficiently close intervals to insure that heat tubes 33a and 33b are in intimate contact with the inside surface of vertical support panel 32.

Behind the heat tubes is preferably placed a heat resistant, highly closed cell insulating layer 37. Insulating layer 37 insures that heat generated by heat tubes 33a and 33b is directed into vertical panel 32 so that guide track 7 receives (by conduction) heat sufficient to keep it frost and ice free.

Preferably, insulating layer 37 is a vinyl nitrile polymeric foam having a density of an average of 4.5 to 8.5 pounds per cubic feet, a water absorption by weight of about 0.1 pounds per square foot of cut surface, a high continuous temperature resistance of 150° F., a burn rate of zero inches per minute and better than 95% closed cells.

Insulating layer 37 preferably has a high heat resistance and low flammability because of its contact with heat tubes 33a and 33b in order to prevent risk of fire or other damage to either insulating layer 37 or to the door structure and its surroundings.

High closed cell ratio and low water absorption are preferred because the typical, high humidity, low temperature environment in which the present invention is intended to operate results in large amounts of condensate water forming on insulating layer 37. If high closed cell ratio and low water absorption are not present, the insulating layer 37 will absorb condensate water which will freeze in time in the interstices of the insulating layer 37 effectively eliminating its insulating capabilities.

A high closed cell, low water absorption, high fire resistant material satisfactory for this use is available from Milwaukee Rubber Products of Menomonee Falls, Wis. and is known as Stock No. R1800FS.

Figure 7:
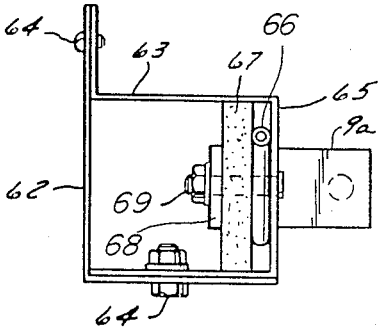
FIG. 7 is a top plan view of the door jamb of the embodiment of FIG. 6 in assembled condition.

Insulating layer 37 is held in place by steel a retaining plate 38 which cooperates with the aforementioned stud 35 and clamping means 36 to clamp the insulating material in position against heat tubes 33a and 33b. It will be evident to workers skilled in the art that the resultant structure is a sandwich configuration as illustrated in FIG. 7 which effectively provides heat to the front outer surface of vertical support panel 32 of the header, thereby insuring absence of frost and ice from guide track 7 and the surrounding area adjacent to the folding area mechanism of the door.

The outside of lower member 41 of header 31 is also subject to frosting or ice formation during use in a cold, damp environment. Hence, heat should be applied to lower member 41 as well. The inventor earlier attempted utilizing conventional electrical resistance heating wires placed against the inside surface of the lower member 41 of header 31. These heat wires were placed in spaced longitudinal rows on the inside of lower member 41, and were held in place with heat resistant tape. In practice it was discovered that such manufacturing process was extremely time consuming and expensive and resulted in a structure with low reliability with respect to the stability of the positioning of the heat wires and resulted in nonuniform heating of the outer surface of lower member.

It has been discovered that these problems could be overcome and the associated manufacturing time and cost of the door greatly reduced by utilizing as a heating element in this portion of the header a fiber mesh heat mat material 42 which is comprised of an openweave fiber glass mesh 43 with a continuous insulated copper heating element 44 permanently bonded thereto in a serpentine formation and installed in header 31 so as to cover a substantial fraction all of the inner surface of lower member 41. Such fiber glass mesh heat mats 42 are easily and rapidly installed and are available commercially in a variety of sizes and heating capacities, cause the heating element 44 to remain permanently in place (because it is bonded to mesh 43 which covers nearly all of the inside face of lower member 41 and is, hence, effectively immobilized), and have a minimal number of electrical connections as compared to conventional heat wire installations. Such fiber mesh heat mats are available from Easy Heat, Inc. of New Carlisle, Ind. and are known as Series G fiber mesh heat mats.

These mats have a heating capacity of approximately 40 watts/sq. ft to 60 watts/sq. ft. Such mats are designed for and are used extensively for embedding into asphalt or concrete for deicing driveways, airport runways and the like.

Heat mat 42 has behind it a closed cell second insulating layer 45 which is similar in its composition to insulating layer 37 earlier described.

The assembly of heat mat 42 and second insulating layer 45 are held in place by a retention plate 46 which cooperates with an appropriate number of studs 47*a* and 47*b* and with fastening means 48*a* and 48*b*.

As will be evident, the resultant structure is a sandwich of retention plate 46, second insulating layer 45 and heating mat 42 as illustrated in FIG. 5. Such structure provides intimate, complete and uniform transfer of heat from the heating mat 42 to the entire exterior surface (by conduction) of lower member 41 of a header 32 and, hence insures that no ice or frost will interfere with the movement of rack sections 4, 5 and 6 of the door.

By virtue of the evenly applied heat and the judicious use of low water absorbing insulating layers, the resultant header structure provides for a substantially frost-free and ice-free environment in most circumstances at a low consumption of electrical energy.

The frost and icing difficulties associated with the header of a high-speed folding door are also present in the side jamb area wherein the side jamb comes in close proximity with bearing bolt 9*a*, hinge pipe 10 and lower support plate 11, as previously described.

Figure 6:
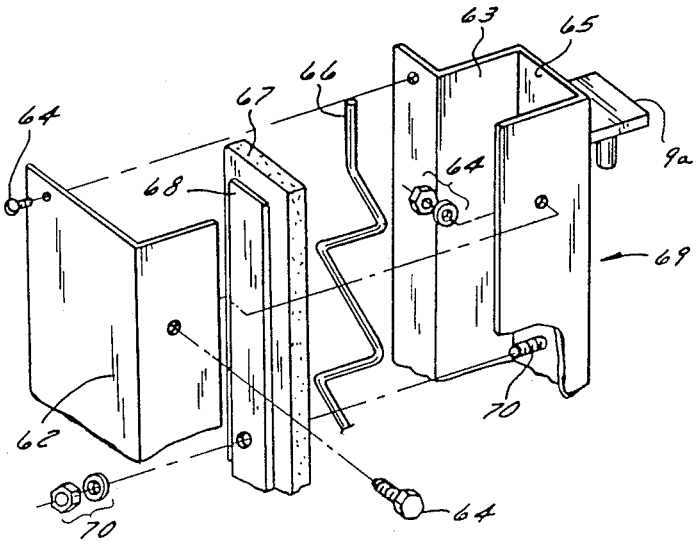
FIG. 6 is an exploded, partial perspective view of the door jamb of one embodiment of the invention.

In the embodiment illustrated by FIGS. 6 and 7, a jamb 69 of the door is formed of a first box section 62 and a second box section 63, which together form essentially a box shaped jamb 69 when fastened together by fasteners 64. Against the inside of a hinge wall 65 of second box section 63 is situated a jamb heat tube 66 which may be effectively in a serpentine form. Heat tube 66 may be of the same heat tube material as previously described header heat tubes 33*a* and 33*b* which is sufficiently flexible to be formed into serpentine form with conventional hand forming techniques but sufficiently rigid to retain its shape during assembly and in service. Jamb heat tube 66 is backed by a jamb insulating layer 67 which may effectively be of a material the same as previously described header insulating layers 37 and 45. The assembly of jamb heat tube 66 and insulating layer 67 is held in intimate contact with the interior hinge wall 65 by a steel retention plate 68 in cooperation with an appropriate number of fasteners 70. As will be apparent, the resultant structure is a sandwich of heat tube, insulating layer and retention plate as shown in FIG. 7.

Figure 8:
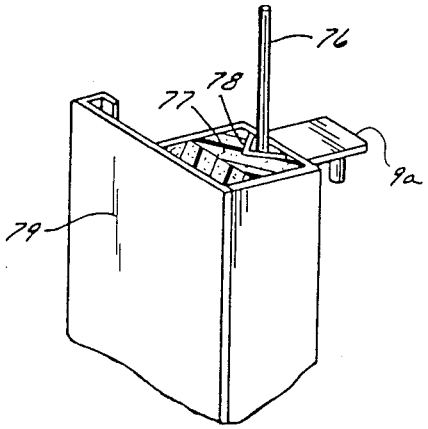
FIG. 8 is a partial perspective view of another embodiment of the door jamb showing the heat tube partially withdrawn from the heat tube passageway.
Figure 9:
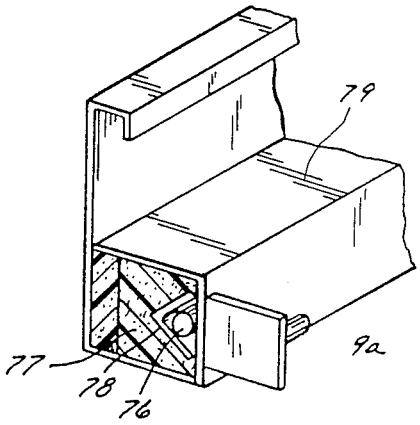
FIG. 9 is an assembled, partial perspective view of of the door jamb of FIG. 8 shown at a different angle.

Another embodiment of the invention which has fewer parts and important assembly advantages is illustrated in FIGS. 8 and 9. In this embodiment the jamb is in the form of a welded box section 79 which has fabricated in it heat tube retention means which may effectively be in the form of an angle section 78 of steel welded into the interior wall of box section 79 on the side of box section 79 on which the door hinge pipe 10 will pass. Angle section 78 should be sized so that a heat tube 73 will intimately contact both the interior wall of box section 79 and the interior wall of angle section 78 when heat tube 76 is inserted into the triangular channel formed by the combination of the wall of box section 79 and angle 78. Jamb insulating layer 77 may be force fit into the open space of box section 79 immediately adjacent to angle section 78 and may be of the same closed cell material previously described.

In addition to having fewer parts than the previously described embodiment of FIGS. 4 and 5, this embodiment is particularly advantageous when it is desired to install a door in a tunnel or other location where access to the outside of the jamb structure for installation or removal of the heat tube is not possible. The open top of the angle section 78 permits heat tube 73 to be inserted or removed from the jamb structure from the top of the door so long as a suitable access port is provided in the header.

It has been discovered that substantial frost and ice elimination at the header and jambs does not require continuous operation of the disclosed heaters. Rather, satisfactory frost and ice elimination at both the header and the jambs is possible if the surface temperature of the header at the point most remote from the header heating elements is kept in the range of 48°-80° F. FIGS. 4–5 show a thermostat probe 51 in an appropriate location within the header remote from the header heating elements Of course, probe 51 is connected to a suitable, conventional thermostatic switch wired into the circuit of the header and jamb heaters to cycle them on and off.

The inventor has found that a surface temperature at this location of 62° F. is most typically adequate to insure a substantially frost and ice free header and jamb at reasonable energy consumption.

Figure 1:
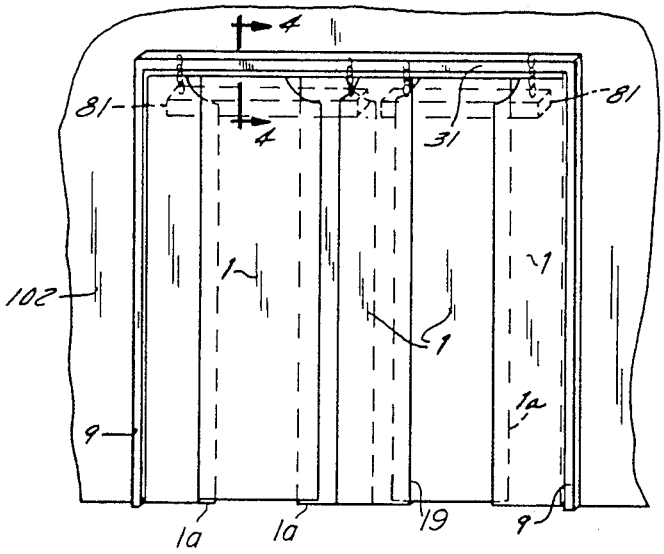
FIG. 1 is a front elevational view of a highspeed, horizontal folding door at the doorway of a freezer case or the like and showing the radiant heater portion of the invention.
Figure 10:
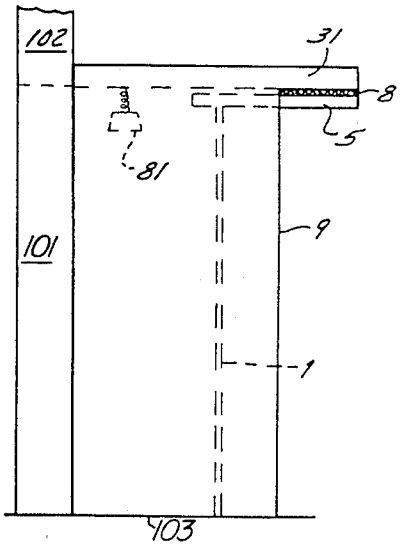
FIG. 10 is a side, elevational view of the door of FIG. 1.

In many cold and humid environments the frost control system described above may be effectively supplemented to prevent frost formation on the downwardly descending curtain of the door and on the floor of the door opening by the installation of one or more electric infrared heaters 81 on the lower surface of the header or on a suitable bracket or other support usually on the "warm side" of the door between descending curtain panels 1 and a wall 102 of the freezer compartment as illustrated in FIGS. 1 and 10. Such electric infrared heaters 81 are chosen to supply a sufficient amount of energy to prevent the formation of ice and frost on the descending curtain panel 1 and on the floor 103 of the door opening. The inventor has discovered that in most installations, two electric infrared heating units of 3,000 watts each are sufficient to prevent ice and frost formation on the door curtain and on the floor of the door opening in environments down to −20° F.

A suitable heater for such use is the Dayton 3E432 heater available from W. W. Grainger, Inc., Milwaukee, Wis.

Figure 11:
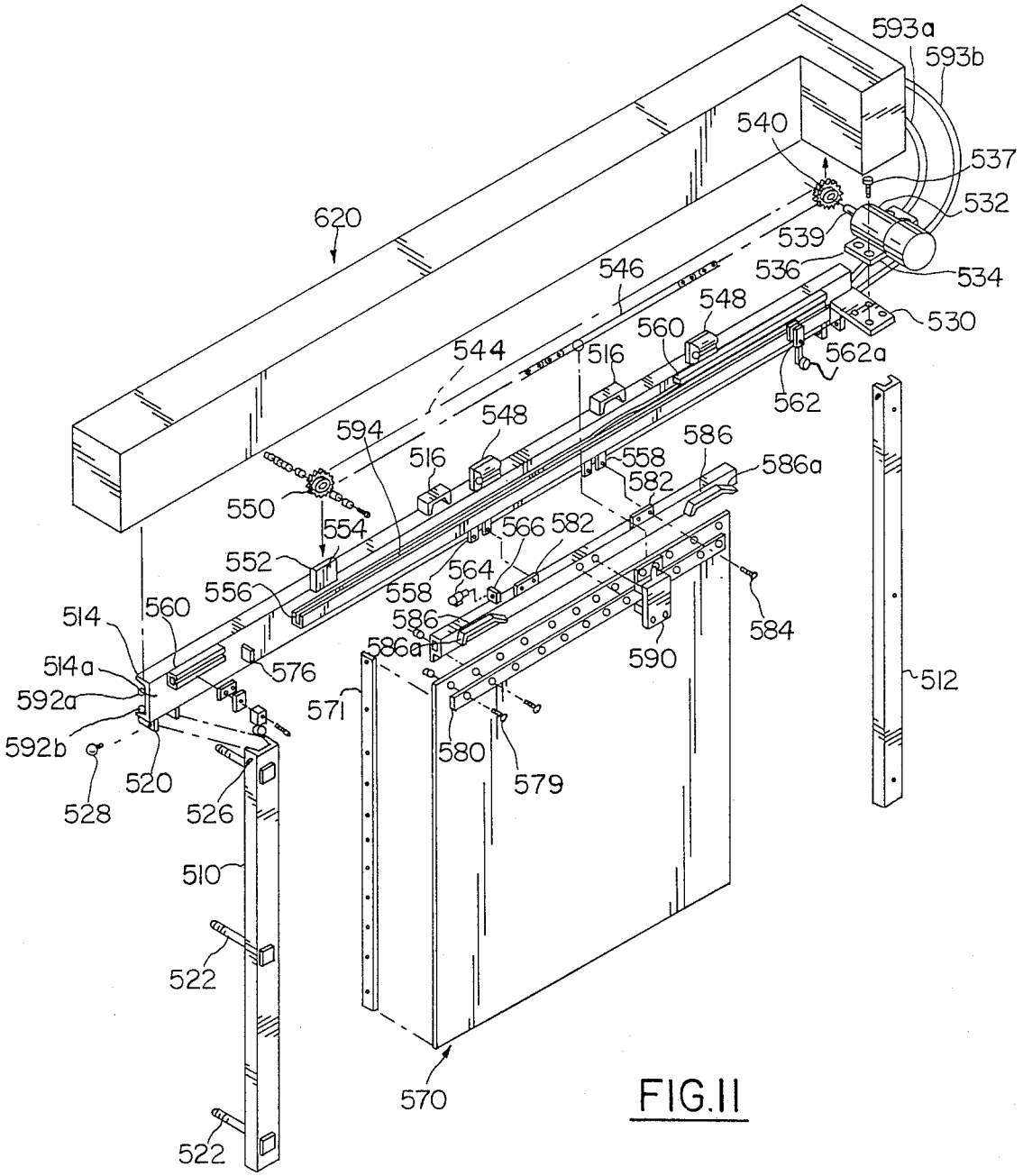
FIG. 11 is an exploded perspective of a sliding door assembly in accordance with the present invention.
Figure 12:
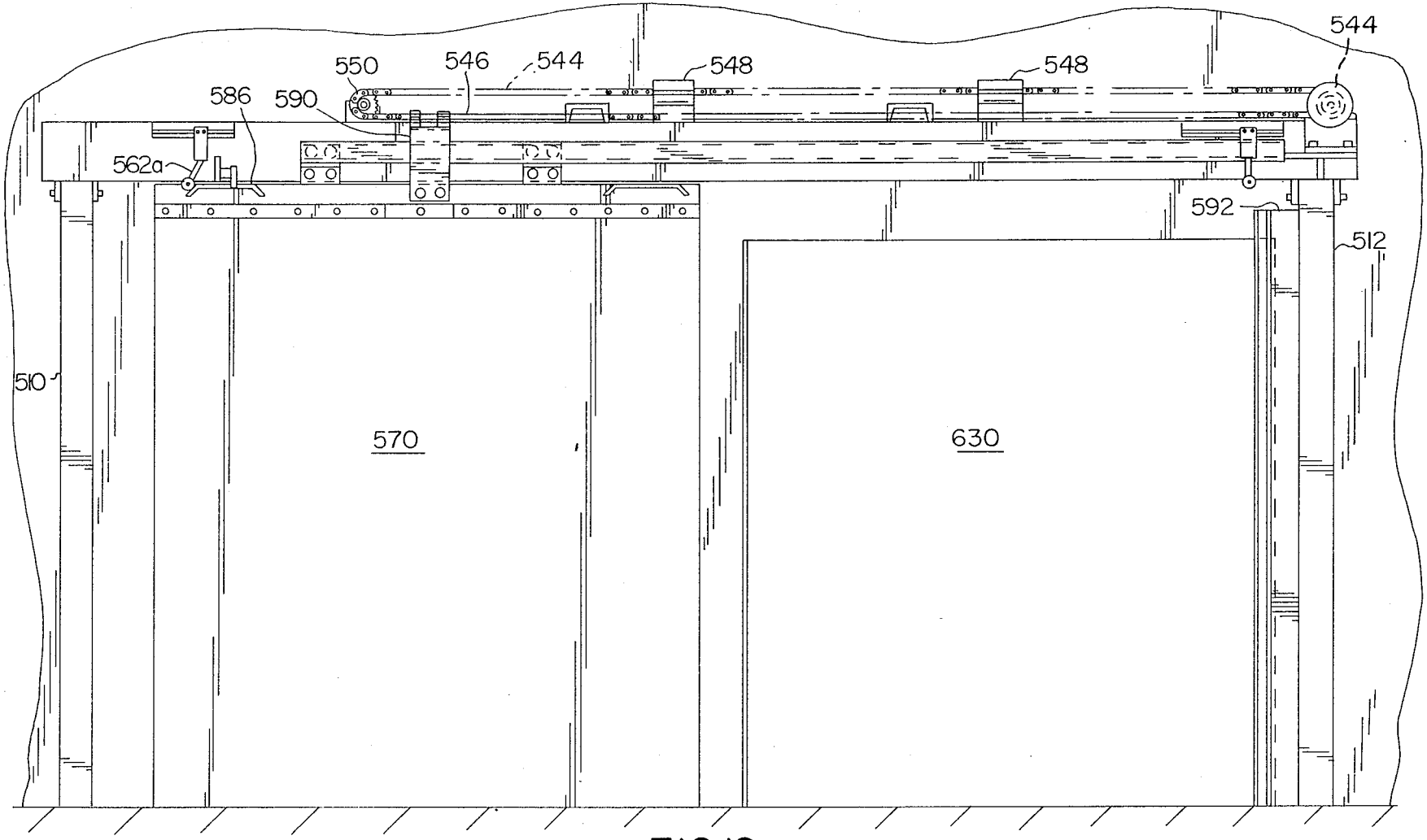
FIG. 12 is a front view of the door in FIG. 11 when closed.
Figure 13:
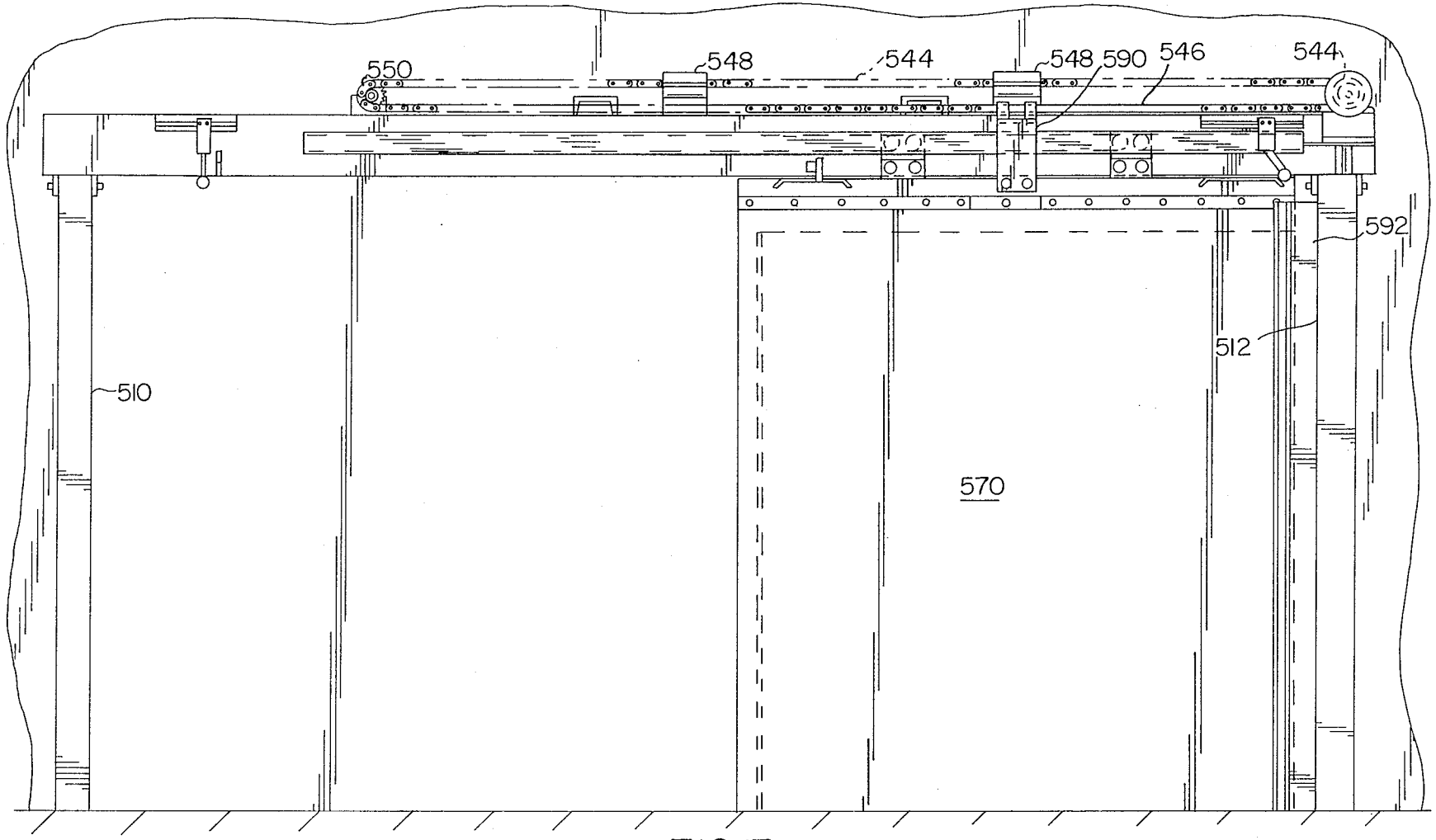
FIG. 13 is a front view of the door in FIG. 11 when open.

Referring to the perspective of FIG. 11, it may be seen that the frame structure employed for the sliding door of the instant application is comprised of two upright jambs 510 and 512 made of a material such as steel or aluminum which is environmentally suited to resist conditions in which the apparatus may be exposed. Typically, the side jambs 510 and 512 are in the shape of a C-shaped channel and are placed a predetermined distance away from the edges of a doorway 630 (best seen in FIG. 12) and bolted into the wall through bolts 522. Additionally, the walls, which frequently are made of a concrete or concrete-like material, require bolts of a type appropriate for firmly adhering heavy materials to concrete. Head channel assembly 514 is then lifted via a lift pocket 516 to the appropriate elevation above the doorway by a forklift apparatus and positioned over side jambs 510 and 512 such that brackets 518 and 520, respectively, are positioned over the top of jambs 510 and 512. Brackets 518 and 520 are provided with bores (not shown) complementary to bores 524 and 526 in jambs 510 and 512 adapted to receive bolts 528 to securely fasten head channel 514 to jambs 510 and 512.

A horizontally positioned flange or motor mount 530 extending outward from channel 514 supports motor 532. Motor 532 is provided with a pair of flanges 534 having adjusting slots 536 therein which coincide with bores 538 in motor mount 530, thereby allowing adjustment of motor 532 along its horizontal axis. Fastener bolts 537 secure flange 534 to mount 530. Motor 532 is coupled via drive axle 539 to a chain sprocket 540 which serves to drive chain 544, shown in dashed lines, and connecting rod 546 when motor 532 is energized. A pair of chain guides 548 integrally attached to head channel 514 guide chain 544 when caused to move by motor 532. A second sprocket 550 is appropriately mounted to sprocket mount 552 connected to head channel 514. Sprocket mount 552 is provided with an adjusting slot 553 allowing movement of sprocket 550 along channel 514 to appropriately tension chain 544. A C-shaped track 556 with the open side directed downwardly is welded or otherwise secured to the front surface 514*a* of head channel 514 and is adapted to receive a plurality of rollers (not shown) of carriage assemblies 558. Front surface 514*a* also is welded to a pair of spaced small channel members 560 which moveably secures a pair of limit switch assemblies 562 adjustable for movement therealong. A hood 620 may be employed to house all of the various components discussed above.

A door 570 is appropriately secured only by the top edges thereof to a flange 578 extending downwardly from door support member 576 by a plurality of fasteners 579 extending through door support strip 580 and flange 578. A pair of flanges 582 extending vertically upward from support member 576 are secured respectively to carriage assemblies 558 (which are moveable along channel number 556) by fasteners 584. A pair of limit switch brackets 586 with cam surfaces 586*a* are welded to the front surfaces 576*a* of support member 576 and provide for engagement with cam follower 562*a* extending from limit switch 562 for a purpose to be described below. Support member 576 is appropriately secured to door support carriage 590 which, in turn, is adjustably secured to connecting rod 546.

Figure 15:
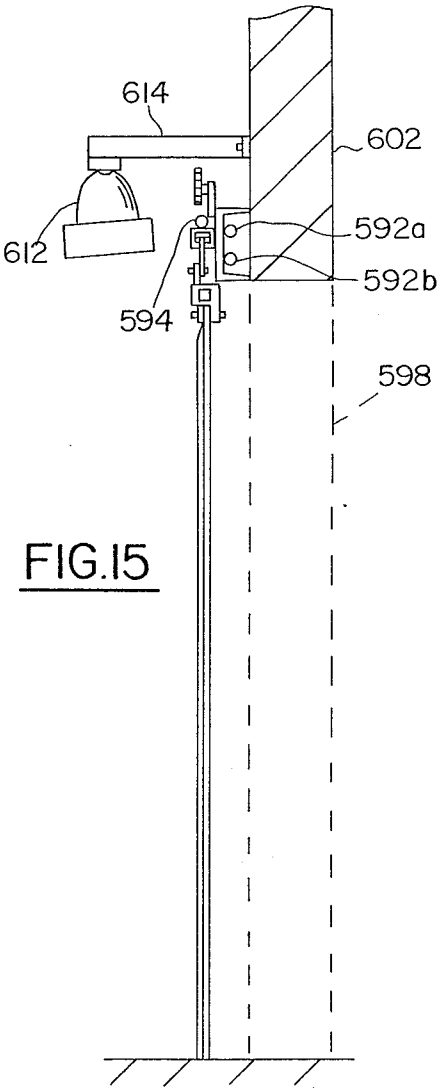
FIG. 15 is a side sectional view of the door of FIG. 12 showing a heating lamp focused upon the normal temperature side of the door which is positioned outside of the insulating door.
Figure 14:
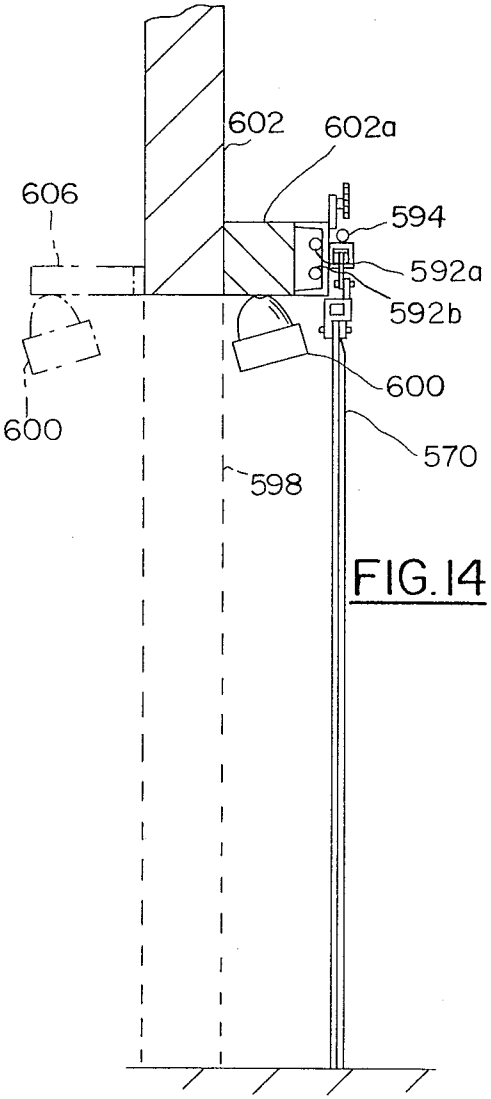
FIG. 14 is a side sectional view of the door of FIG. 12 showing two positions of heating lamps focused upon the normal temperature side of the door which is positioned inside of the insulating door and within the temperature controlled environment of the enclosure.

As best seen in FIGS. 14 and 15, the door of the present invention is advantageously employed to separate the cold interior of a freezer or the like from the warm outside temperatures. To prevent freezing moisture condensing on the warm side of the door 570, various heating elements or preferably heating lamps, may be employed to provide energy on door 570 and its mechanism thereby precluding the formation of moisture. Undue formation of moisture prevents the ability to see through door 570 into the interior thus obviating one of the advantages of such door and may cause a collection of moisture on the floor immediate adjacent door 570. This provides an undesirable hazard since individuals moving into or out of the interior of the freezer may slip and fall. Of course, frost or ice formation on the door actuating mechanism may cause it to malfunction.

To provide a seal to the gap between the sidewalls and door 570, vertically positioned seal strip 571 may be attached to the wall immediately adjacent the doorway. The strip 571 should be flexible enough to withstand repeated movement of door 570 thereby.

Depending upon whether the door is interior to or exterior of a doorway, a plurality of radiant lamps may be positioned to focus upon the warm side facing surface of door 570. As seen in FIG. 14, door 570 positioned inside of insulated door 598. Radiant lamps 600 are secured to an extension 602*a* to the underside of door overhang 602 and focused upon the side of door 570 facing the warm side. Alternatively, however, lamp 600 may be attached to a bracket 606 (all shown in dashed lines) secured to the exterior surface of door overhang 604 and focused again on the warm side of door 570. To provide sufficient energy to prevent the formation of ice and frost on the warm side of door 570, it has been determined that in most situations down to a temperature of about −20° C., two lamps of about 3000 watts each are sufficient if positioned not more than 60 inches from the surface of door 570. Similarly, if door 570 is positioned exterior to insulated door 600 as seen in FIG. 15, then lamps 612 may be secured to the underside of a bracket 614 extending from overhang 602. Suitable lamp heaters for this use may be obtained from W. W. Grainger, Inc., of Milwaukee, Wis., under the name of Dayton 3E432 Heater.

In addition to the radiant heat lamps described above, copper tube heaters, such as described earlier in this specification with respect to the folding door application, may be employed in association with the head channel assembly 514 and C-shaped channel member or track 556. More particularly, electrical copper tube heaters 592*a* and 592*b* are fitted into the open side of head channel assembly 514 so that the copper tube heaters 592*a* and 592*b* are in intimate contact with the inner surface of head channel assembly 514. Electrical wires 593*a* and 593*b* run from copper tube heaters 592*a* and 592*b* to a suitable electrical control box, power source and thermostat (not shown). The inventor has determined that copper tube heaters with a capacity on the order of 10 watts per linear foot are suitable for most freezer applications. Such heaters are made by Easy Heat, Inc., New Carlisle, Ind.

In addition, a further copper tube heater 594 may be advantageously fitted to the upper surface of C-shaped track 556. Such copper tube heater 594 may also advantageously be a 10 watt per linear foot heater and connected to the same power source and electrical control box and thermostat as electrical wires 593*a* and 593*b*.

Whether used on their own or in conjunction with previously-described radiant lamp 600, copper tube heaters 592*a*, 592*b* and 594 provide sufficient heat to prevent the formation of ice and frost on the critical surfaces of head channel assembly 514 and track 556 which, if covered with frost or ice, would interfere with the movement of carriage assemblies 558 in the track of C-shaped track 556.

It will be understood that the above description is of two preferred exemplary embodiments of the invention, and the invention is not limited to the specific form shown. Modifications may be made in the described elements without departing from the scope of the invention as expressed in the appended claims.

I claim:

1. A slidable door comprising:

a header disposed along the top of a doorway, said header including a front, generally upright panel;

a downwardly depending curtain disposed below said header;

means connected to said header for movably supporting said curtain for movement between a closed, extended position and an open, retracted position in which an upper edge portion of said curtain is disposed in front of said front panel and in close proximity thereto;

front panel temperature raising means disposed on said header for raising the temperature of said front panel above a frost formation temperature, said front panel temperature raising means comprising:

front panel heat transferring means superposed on a face of said front panel to transfer heat to said front panel; and retention means for securing said front panel heat transferring means to said front panel.

2. The slidable door of claim 1, wherein said front panel heat transferring means comprises a first heating element and means for securing said first heating element on said front panel from movement and for distributing heat from said heating element to said front panel.

3. The slidable door of claim 2, wherein said first heating element comprises an electrical resistance heater extending on an inner face of said front panel.

4. The slidable door of claim 2, wherein said first heating element has an output in the range of about 5–20 watts per linear foot.

5. The slidable door of claim 2 wherein a first insulating layer comprised of a substantially closed cell, substantially non-water absorbing, substantially nonflammable foam material covers said front panel heat transferring means.

6. The slidable door of claim 5 wherein said first insulating layer is made of vinyl nitrile foam.

7. The slidable door of claim 1, including: means for raising the temperature at a floor level of said doorway above a frost formation temperature.

8. The slidable door of claim 7 wherein said means for raising the temperature at said floor level comprises an electrical radiant heater in proximity with said front panel.

9. The slidable door of claim 1, including: means for simultaneously raising both a surface temperature of said curtain and a temperature at a floor level of said doorway above a frost formation temperature.

10. A slidable freezer door comprising:

header disposed along the top of and spanning a doorway;

a downwardly depending transparent curtain disposed below said header;

means cooperating with said header and said curtain for movably supporting said curtain for movement between a closed, extended position and an open, retracted position wherein, when said curtain is in said extended position, said curtain comprises a first vertical surface exposed to a first zone within a freezer and a second vertical surface exposed to a second zone outside the freezer; and a radiant heat lamp, mounted proximate said doorway in said second zone, including means for directing a supply of radiant heat energy at said second vertical surface of said curtain to thereby inhibit the formation of frost on said second vertical surface.

11. The freezer door of claim 10, wherein said radiant heat lamp comprises an infrared heater.

12. The freezer door of claim 11, wherein said radiant heat lamp is positioned up to about 60 inches from said second surface of said curtain.

13. The freezer door of claim 11, wherein said infrared heater is configured to generate approximately 3,000 watts of radiant energy.

14. The freezer door of claim 13, wherein said radiant heat lamp is positioned up to about 60 inches from said second surface of said curtain.

15. The freezer door of claim 10, wherein said radiant heat lamp comprises at least two electric infrared heating units, each configured to generate in the range of about 3,000 watts of radiant energy.

16. The freezer door of claim 10, wherein said radiant heat lamp is positioned up to about 60 inches from said second surface of said curtain.

17. A folding freezer door, comprising;

a header disposed along the top of a freezer doorway and including a bracket extending therefrom;

a downwardly depending, substantially transparent curtain disposed below said header;

means, operatively associated with said header, for movably supporting said curtain for movement between a closed, extended position and an open, retracted position, said curtain including a first surface exposed to a freezer zone and a second, oppositely disposed surface facing away from the freezer zone when said curtain is in said extended position;

radiant heat means, mounted to said bracket, for generating a supply of radiant energy; and directing means, cooperating with said radiant heat means, for directing the radiant energy to said second surface of said curtain to thereby inhibit the accumulation of frost on said second surface.

18. The freezer door of claim 17, wherein said radiant heat means comprises a 3,000 watt infrared heat lamp mounted up to approximately 60 inches from said curtain.

* * * * *